US006580348B1

(12) United States Patent
Hundt et al.

(10) Patent No.: US 6,580,348 B1
(45) Date of Patent: Jun. 17, 2003

(54) FLAT MAGNETIC CORE

(75) Inventors: Harald Hundt, Dieburg (DE); Johannes Beichler, Eppertshausen (DE)

(73) Assignee: Vacuumschmelze GmbH (DE)

( * ) Notice: Subject to any disclaimer, the term of this patent is extended or adjusted under 35 U.S.C. 154(b) by 0 days.

(21) Appl. No.: 09/914,019

(22) PCT Filed: Feb. 1, 2000

(86) PCT No.: PCT/DE00/00300

§ 371 (c)(1),
(2), (4) Date: Dec. 10, 2001

(87) PCT Pub. No.: WO00/51146

PCT Pub. Date: Aug. 31, 2000

(30) Foreign Application Priority Data

Feb. 22, 1999 (DE) ..... 199 07 542

(51) Int. Cl.[7] ..... H01F 27/02
(52) U.S. Cl. ..... 336/83; 148/113; 336/212
(58) Field of Search ..... 148/113; 336/83, 336/212, 200

(56) References Cited

U.S. PATENT DOCUMENTS

| | | | | |
|---|---|---|---|---|
| 4,144,058 | A | | 3/1979 | Chen et al. |
| 4,487,812 | A | | 12/1984 | Kawasaki et al. |
| 4,608,297 | A | | 8/1986 | Shimada et al. |
| 4,904,527 | A | | 2/1990 | Nolle et al. |
| 5,529,831 | A | | 6/1996 | Waga et al. |
| 5,833,769 | A | | 11/1998 | Kogiku et al. |
| 2001/0050182 | A1 | * | 12/2001 | Takeshita et al. ..... 174/261 |
| 2002/0056816 | A1 | * | 5/2002 | Stark ..... 250/493.1 |

FOREIGN PATENT DOCUMENTS

| | | | |
|---|---|---|---|
| AT | 29 331 | B | 3/1988 |
| DE | 21 46 344 | B2 | 3/1972 |
| DE | 33 26 556 | C2 | 2/1984 |
| DE | 32 44 823 | A1 | 6/1984 |
| DE | 35 03 019 | C2 | 7/1986 |
| EP | 0 021 101 | | 1/1981 |
| EP | 0 038 957 | A | 11/1981 |
| EP | 157669 | | 9/1987 |
| EP | 0 271 657 | | 6/1988 |
| EP | 0 288 768 | A2 | 11/1988 |
| EP | 0 621 612 | A1 | 10/1994 |
| EP | 0 677 856 | A1 | 1/1995 |
| EP | 0 794 541 | A | 9/1997 |
| EP | 0 899 753 | A | 3/1999 |
| GB | 2 318 218 | A | 4/1998 |
| JP | 57 005314 | A | 1/1982 |
| JP | 09 097717 | A | 4/1997 |

* cited by examiner

*Primary Examiner*—Anh Mai
(74) *Attorney, Agent, or Firm*—Dean W. Russell; Kilpatrick Stockton LLP

(57) ABSTRACT

A toroidal tape core is produced from magnetic sheets (1) which may have slits (4). In order to improve the behavior of the toroidal cores (3) at high frequencies, the magnetic sheets (1) have a high surface roughness. The surface roughness of each magnetic sheet (1) is at least equal to the skin penetration depth at the frequency being used.

11 Claims, 5 Drawing Sheets

FLAT MAGNETIC CORE

BACKGROUND OF THE INVENTION

1. Field of the Invention

The invention concerns a component of low overall height for circuit boards having a magnetic region formed by at least one layer made of a soft-magnetic material.

2. Description of the Related Art

A component of this type is known from U.S. Pat. No. 5,529,831. The known component is produced by applying insulator films, conductor films, and a magnetic film onto the substrate. A typical sputtering process is used to apply these films.

A disadvantage of this type of component is that it can only be produced with the aid of a costly thin-film process. In addition, depending on the process, only low film thicknesses in the range of a few $\mu$m can be produced. The cross-sections of the magnetic regions produced with the aid of this process are correspondingly small. A further disadvantage is that with this type of component, the windings must also be produced with the aid of a costly thin-film process.

SUMMARY OF THE INVENTION

Proceeding from this prior art, the object of the invention is to create an easily producible component of high inductivity for use on circuit boards.

This subject is achieved according to the invention in that the magnetic region is formed by at least one soft-magnetic sheet. The surface roughness of each sheet is at least equal to the skin penetration depth at the usage frequency.

Magnetic sheets can typically be produced with thicknesses in the range from 10 to 25 $\mu$m. If they are stacked on top of one another, significantly larger cross-sections of the magnetic region than those of magnetic regions produced in thin-film processes thus result. As a consequence, the inductivity of a component equipped with this type of magnetic region is relatively high. Nonetheless, the component according to the invention has a low overall height and is therefore also suitable for SMD technology in this regard. It is particularly favorable for high frequency applications that the surface roughness of each sheet is at least equal to the skin penetration depth at the usage frequency.

Further embodiments and developments are the object of the dependent claims.

BRIEF DESCRIPTION OF THE DRAWINGS

In the following, exemplary embodiments of the invention are described with reference to the attached drawing.

DETAILED DESCRIPTION OF SPECIFIC EMBODIMENTS OF THE INVENTION

Figure 1A:
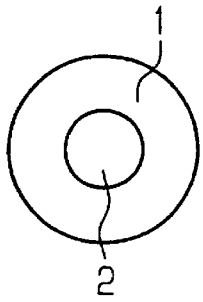
FIGS. 1A to 1C show various embodiments of magnetic sheets which could be considered for usage in a magnetic region of a component.
Figure 1B:
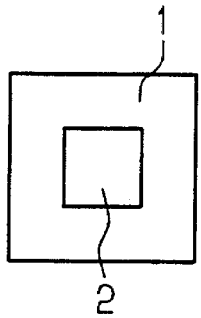
Figure 1C:
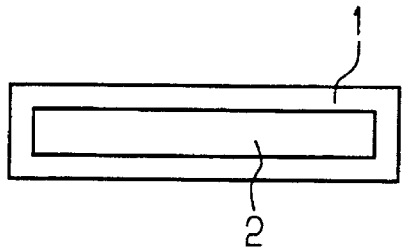

Various embodiments of a magnetic sheet 1 are illustrated in FIGS. 1A to 1C. The magnetic sheet 1 illustrated in FIG. 1A has a circular ring shape. In contrast, the magnetic sheets 1 from FIGS. 1B and 1C have a ring shape with rectangular contours. The magnetic sheets 1 are, for practical purposes, produced from an amorphous or nanocrystalline alloy. Amorphous alloys based on iron are, for example, known from U.S. Pat. No. 4,144,058. Amorphous alloys based on cobalt are, for example, known from EP-A-0 021 101. Finally, nanocrystalline alloys are described in EP-A-0 271 657. Thin sheets with a typical thickness of 10 to 25 $\mu$m, or sometimes, greater or lesser thicknesses, can be produced from the materials mentioned. The ring-shaped magnetic sheets 1 can then be stamped out of the thin sheets.

Figure 2:
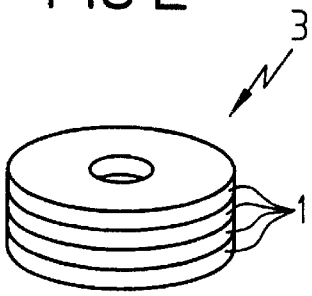
FIG. 2 shows a perspective view of a sequence of magnetic sheets stacked on top of one another.

The stacked magnetic sheets 1 result in a toroidal core 3, as illustrated in FIG. 2, with the thickness of the magnetic sheets 1 being exaggerated in FIG. 2 in comparison to the diameter, as the diameter of magnetic sheets 1 is in the range of a few millimeters, while the thickness of, the magnetic sheets 1 is in the range of 10 $\mu$m.

The magnetic sheets 1 can be glued to one another to increase the strength of the toroidal core 3. For high frequency applications, it is also practical for damping of eddy currents to insulate the magnetic sheets 1 from one another on one or both sides by the application of an insulator film. The adhesive film can assume the task of an insulator film at the same time.

Figure 3:
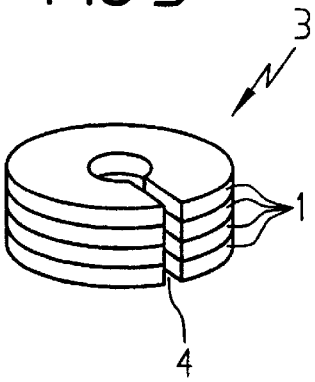
FIG. 3 shows a sequence of magnetic sheets stacked on top of one another which are provided with a gap.

In order to adjust the magnetic properties of the toroidal core 3, a slit 4 is produced in the toroidal core 3 illustrated in FIG. 3, which shears the hysteresis loop. In the exemplary embodiment illustrated in FIG. 3, the slit 4 is produced after the stacking of the magnetic sheets 1 and the gluing of the magnetic sheets 1.

Figure 4:
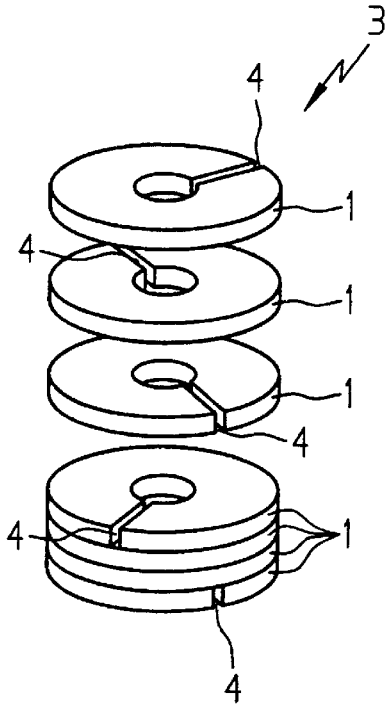
FIG. 4 shows an exploded view of a magnetic region formed from magnetic sheets with an offset gap.

In contrast, in the exemplary embodiment illustrated in FIG. 4, the magnetic sheets 1 are first individually provided with the slit 4 and then stacked on one another and glued to one another. The production of the exemplary embodiment illustrated in FIG. 4 is more costly than that of the exemplary embodiment from FIG. 3, but the toroidal core 3 from FIG. 4 has a higher mechanical strength.

Figure 5:
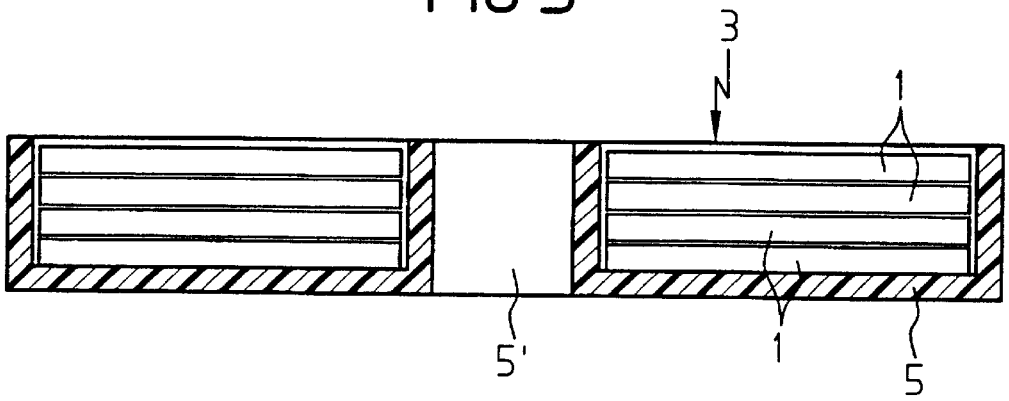
FIG. 5 shows a cross-sectional view of a stack of magnetic sheets embedded in a plastic trough.
Figure 6:
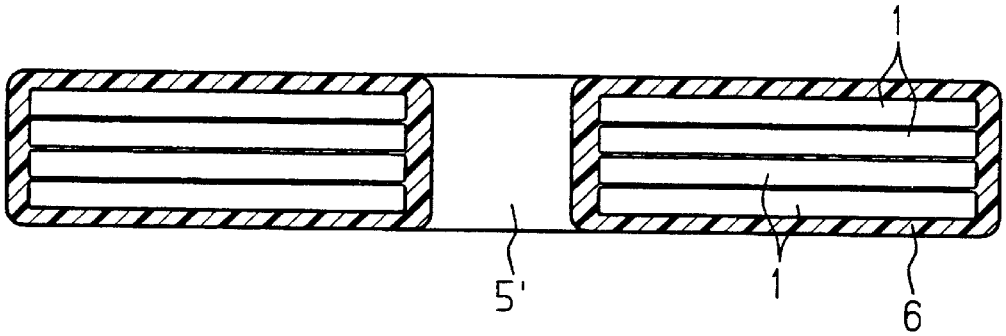
FIG. 6 shows a cross-sectional view through a stack of magnetic sheets enclosed by a polymer film.

According to FIG. 5, it is provided that the toroidal core 3 be placed in a trough 5 manufactured from plastic to protect the toroidal core 3 from mechanical damage. The trough 5 can then be wound with a winding through an inner hole 5', without danger of the toroidal core 3 formed by the magnetic sheets 1 being damaged during winding.

In addition, there is the possibility of enclosing the toroidal core 3 with a polymer film 6. This polymer film 6 is, for practical purposes, a polymer film precipitated from the gaseous phase, for example a polyparaxylene. This process has the advantage that the gaseous polymer material penetrates into even the smallest cracks and that in this way the magnetic sheets 1 are also mechanically bonded to one another, without the magnetic sheets 1 being mechanically strained. A mechanical strain can, due to magnetostriction, disadvantageously change the magnetic properties of the magnetic sheet 1.

It is further advantageous for high frequency applications if the surface roughness $R_A$ of the magnetic sheets 1 is approximately equal to the skin penetration depth $\delta_{skin}$ at the usage frequencies.

Figure 7:
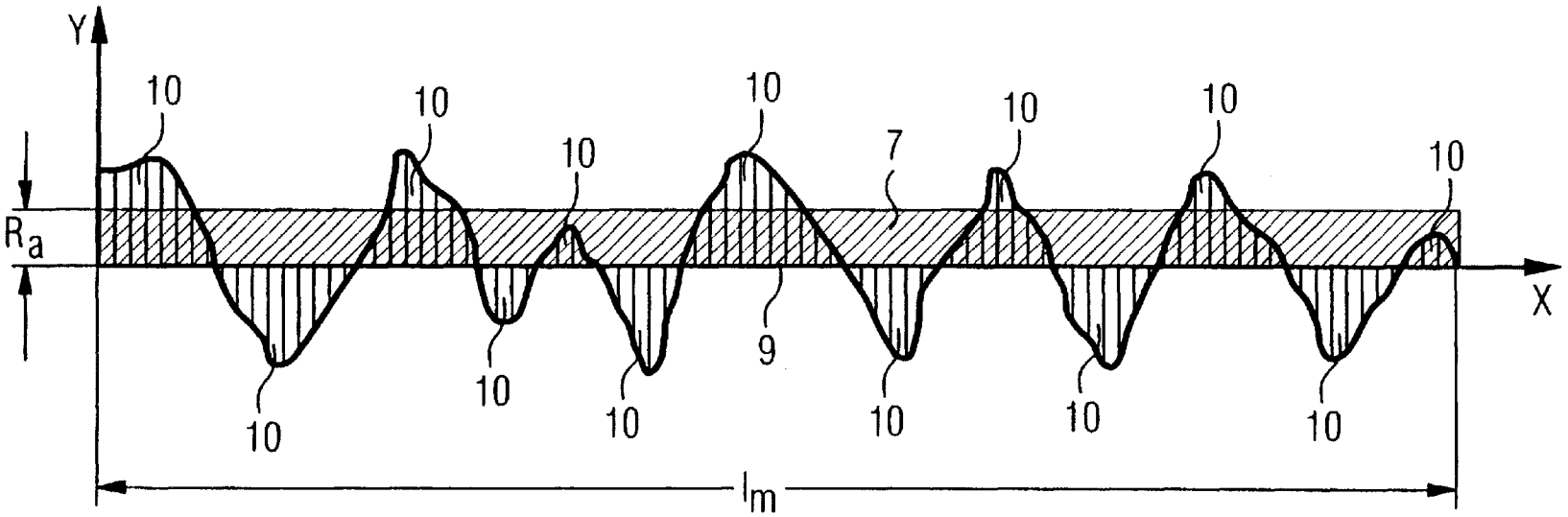
FIG. 7 shows an illustration which clarifies the definition of surface roughness.

The definition of the peak-to-valley depth is explained in the following with reference to FIG. 7. In this case, the x-axis is parallel to the surface of the body whose surface roughness $R_A$ is to be determined. The y-axis, in contrast, is parallel to the surface normal of the surface to be measured. The surface roughness $R_A$ then corresponds to the height of a rectangle 7 whose length is equal to a total measurement path $I_M$ and which is equal in area to the sum of the surfaces 10 enclosed between a roughness profile 8 and a center line 9. The two-sided surface roughness $R_{A\ rel}$ relative to the thickness of the magnetic sheet 1 then results according to the formula $$R_{A\ rel}=(R_{A\ upper\ side}+R_{A\ lower\ side})/d,$$

with d being the thickness of the magnetic sheet 1.

The surface roughness $R_A$ of the magnetic sheets 1 then affects the length of the current paths, which determine the eddy currents. If the skin penetration depth $\delta_{skin}$ is less than half of the sheet thickness at the usage frequencies, the currents flowing in the magnetic sheet 1 are thus predominantly restricted to a boundary layer of the magnetic sheet 1 with a thickness equal to the skin penetration depth $\delta_{skin}$. If the surface roughness $R_A$ of the magnetic sheet 1 is then in the range of the skin penetration depth $\delta_{skin}$, the eddy currents must follow the surface modulated by the surface roughness $R_A$, which leads to lengthened current paths and therefore to a noticeably increased specific resistance. However, an increased eddy current limiting frequency also results from this.

Figure 8:
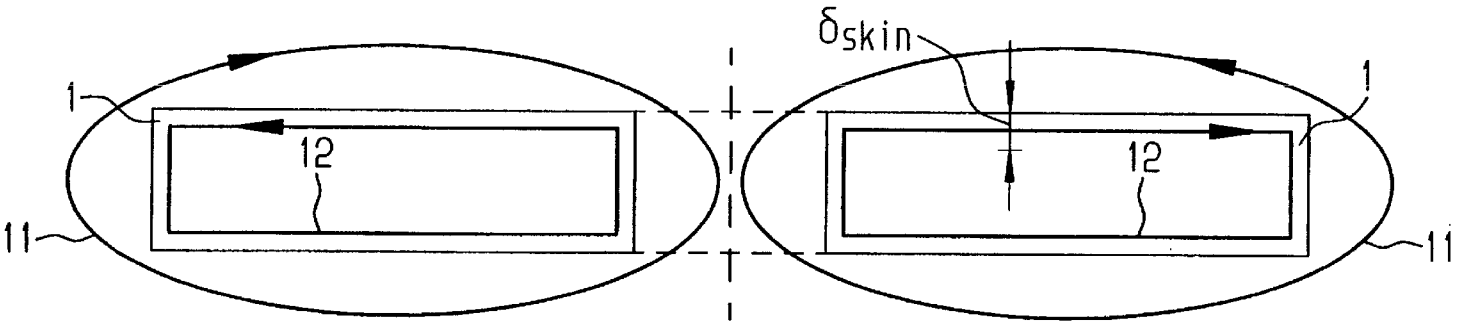
FIG. 8 shows a schematic illustration of the course of the eddy currents for a smooth tape.
Figure 9:
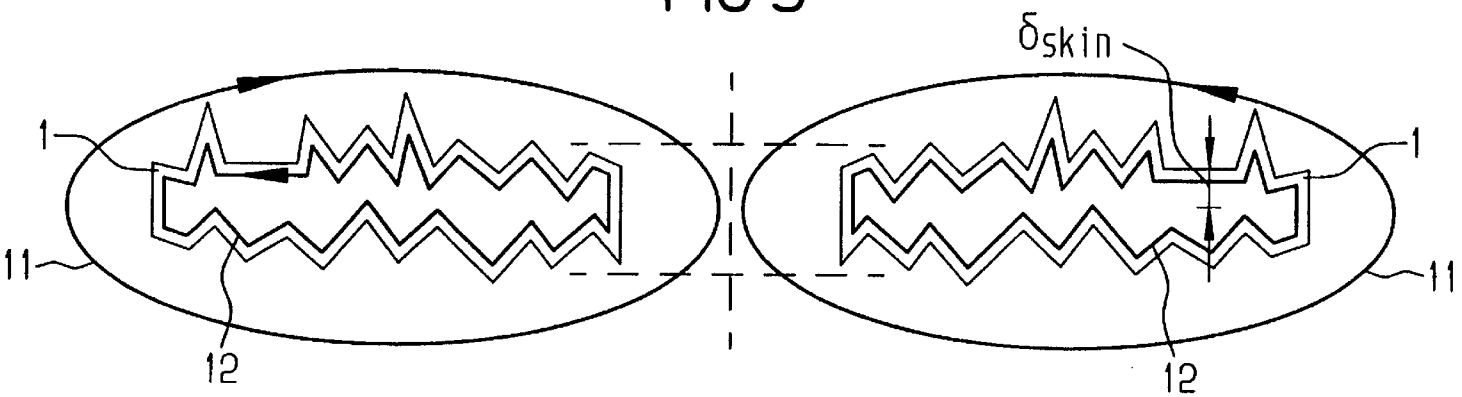
FIG. 9 shows a schematic illustration of the course of the eddy currents for a rough tape.

These relationships are illustrated in FIGS. 8 and 9. The winding currents 11 flowing in an outer winding produce eddy currents 12 in the magnetic sheet 1 in a surface region with a thickness equal to the skin penetration depth $\delta_{skin}$. If the surface roughness of the magnetic sheet 1 is then greater than the skin penetration depth $\delta_{skin}$, lengthened current paths result for the eddy currents 12, which leads to an increased eddy current limiting frequency.

The surface roughness selected can, however, not be arbitrarily large, because the magnetic sheets 1 can, in the extreme case, have holes, which strongly reduces the permeabilities achievable.

Figure 10:
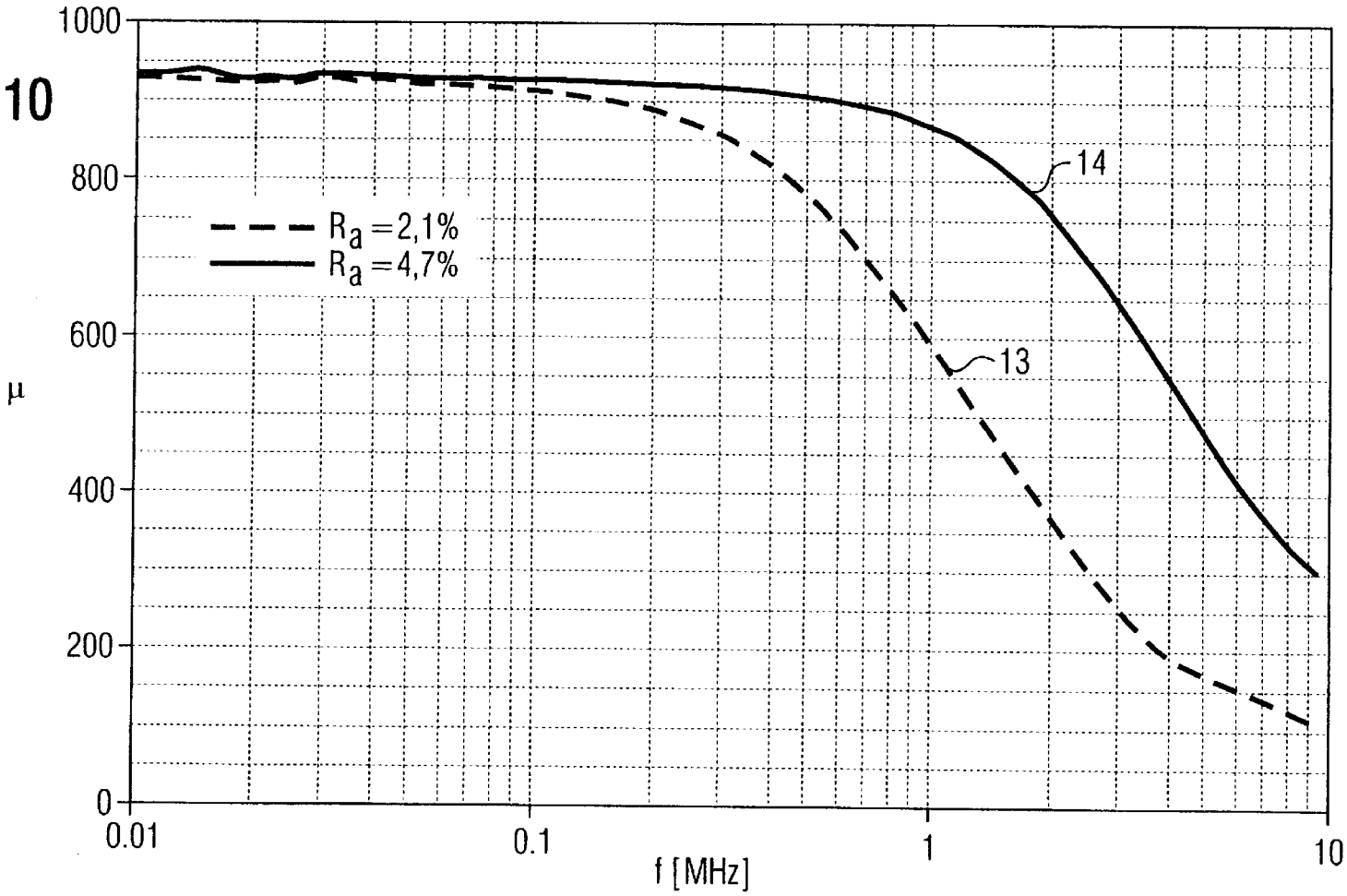
FIG. 10 shows a diagram of the frequency response of components made of smooth and rough magnetic sheets.

In FIG. 10, the influence of the surface roughness on the frequency dependency of the permeability $\mu$ described is illustrated with reference to measurement results. The magnetic sheets 1 measured are magnetic sheets 1 made of an alloy with the composition $(CoFeNi)_{78,5}(MnSiB)_{21,5}$. A dashed curve 13 illustrates the dependence of the permeability $\mu$ on the frequency f at a total surface roughness of 2.1% relative to the thickness of the magnetic sheet 1. A solid curve 14 further illustrates the dependence of the permeability $\mu$ on the frequency f at a total surface roughness of 4.7% relative to the thickness of the magnetic sheet 1. It can be clearly seen that the eddy current limiting frequency is displaced toward higher values by the greater surface roughness. It has been proven to be favorable if the two-sided surface roughness of the upper and lower sides is >3% relative to the thickness of the magnetic sheets 1.

In the following, the advantages of the toroidal core 3 produced from the magnetic sheets 1 are described with reference to an example. A reactor used in telecommunications is to serve as the example. For this type of reactor, an $A_L$ value of 1 $\mu$H is required in the flattest possible structural shape. The inductivity L is $A_L \times N^2$ in this case, with N being the number of windings. The typical usage frequencies of a reactor of this type are in the range of 20 kHz to 100 kHz, or higher in some cases. The smallest ferrite core commercially available at this time is a MnZn-ferrite toroidal core from the firm Taiyo Yuden with an outer diameter of 2.54 mm, an inner diameter of 1.27 mm, and a height of 0.8 mm. The material AH 91 used for production of the MnZn-ferrite toroidal core has an initial permeability of $\mu$=10,000.

If an amorphous cobalt-based alloy with the composition $Co_{62,35}Fe_{3,92}Mn_{1,14}Si_{9,72}Mo_{0,40}B_{2,46}$, which has an initial permeability $\mu$=50,000, is used, an $A_L$ value of 1 $\mu$H can be achieved with a significantly smaller toroidal core 3. For example, the toroidal core 3 with an outer diameter of 2.54 mm, an inner diameter of 1.8 mm, and a height of 0.4 mm could be considered. This toroidal core 3 has an inner hole which is twice as large as that of the ferrite core, which allows either more turns or turns with an enlarged conductor cross-section.

The same $A_L$ value can also be achieved with the toroidal core 3 with an outer diameter of 4.0 mm, an inner diameter of 2.85 mm, and an overall height of 0.4 mm. This toroidal core 3 has an inner hole which is larger than that of the ferrite core by a factor of 5.

Conversely, with the same outer and inner diameter, i.e. an outer diameter of 2.54 mm and an inner diameter of 1.27 mm, an overall height of 0.2 mm is sufficient to achieve an equal $A_L$ value.

If material with even higher initial permeabilities is used, for example an alloy with the composition $Co_{61,06}Fe_{4,21}Si_{9,43}Mo_{2,93}B_{2,35}$, which has an initial permeability of $\mu$=80,000, the overall height of the toroidal core can be reduced further. A toroidal core 3 made of the alloy with the composition $Co_{61,06}Fe_{4,21}Si_{9,43}Mo_{2,93}B_{2,35}$, which has an initial permeability $\mu$=80,000, only requires an overall height of 0.125 mm with an outer diameter of 2.54 mm and an inner diameter of 1.27 mm to achieve an $A_L$ value of 1 $\mu$H. The toroidal core 3 manufactured from this alloy has an overall height which is smaller by a factor of 6.4 than the ferrite core.

A further possible application is the use of the toroidal core 3 as the $S_o$transformer in PCMCIA cards. In card type I, $S_0$ transformers with an overall height of 2.2 mm are necessary so that the permissible overall height of 3.3 mm for a PCMCIA card is not exceeded. Taking into account the winding and the housing walls, a maximum overall height of 1 mm remains for the toroidal core 3. To achieve the required inductivity of approximately 5 mH at 20 kHz, for example, a toroidal core 3 with an outer diameter of 8.6 mm, an inner diameter of 3.1 mm, and an overall height of 1 mm is necessary. The toroidal tape cores used for this purpose until now are very mechanically sensitive and can therefore only be produced with a high rejection rate. For example, one problem is the high winding offset, due to which the core height is not met. In contrast, the toroidal core 3 can easily be produced with high dimensional accuracy.

Linear hysteresis loops with low losses and high permeability can be achieved through suitable heat treatment in an external magnetic field by the use of the amorphous or nanocrystalline alloys. In addition, due to the naturally insulating surface film of these alloys, it is not necessary, in contrast to crystalline alloys, to insulate the magnetic sheets 1 from one another by an additional insulating film. In addition, in comparison to crystalline alloys, the amorphous or nanocrystalline alloys have a higher specific resistance, which leads to higher eddy current limiting frequencies. Depending on the production, the amorphous and nanocrystalline alloys also have a natural surface roughness to a greater or lesser degree, which can, however, be increased further by grinding or etching. The thickness of the magnetic sheets 1 is between 5 and 40 $\mu$m. In the extreme case, the toroidal core 3 is formed by one single magnetic sheet 1. In this way, extremely low overall heights can be achieved simultaneously with favorable high frequency behavior.

What is claimed is:

1. A component of low overall height for circuit boards having a magnetic region formed by at least one layer made of a soft-magnetic material, the magnetic region comprising at least one soft-magnetic magnetic sheet having a surface roughness at least equal to skin penetration depth at usage frequency.

2. The component according to claim 1, wherein the at least one magnetic sheet is produced from a nanocrystalline or amorphous alloy.

3. The component according to claim 2, wherein the surface roughness of the at least one magnetic sheet is >3% relative to its thickness.

4. The component according to claim 1, wherein the magnetic region is formed by multiple magnetic sheets glued to one another.

5. The component according to claim 1, further comprising more than one magnetic sheet, wherein the magnetic sheets are insulated from one another by insulating intermediate films.

6. The component according to claim 1, wherein the at least one magnetic sheet is ring-shaped.

7. The component according to claim 6, wherein the at least one magnetic sheet is generally ring-shaped and has slits.

8. The component according to claim 7, wherein the slits are positioned on top of one another.

9. The component according to claim 7, wherein the slits are positioned at offset angles.

10. The component according to claim 1, wherein stacked magnetic sheets are embedded in a plastic trough.

11. The component according to claim 1, wherein magnetic sheets are stacked on one another and enclosed by a polymer film.

* * * * *